US005111114A

United States Patent [19]

Wang

[11] Patent Number: 5,111,114

[45] Date of Patent: May 5, 1992

[54] FLUORESCENT LAMP LIGHT BALLAST SYSTEM

[75] Inventor: Chen-Chan Wang, Feng-Shan, Taiwan

[73] Assignee: L.P.S. Technology Co., Ltd., Taiwan

[21] Appl. No.: 716,896

[22] Filed: Jun. 18, 1991

[51] Int. Cl.[5] ..... H05B 41/29

[52] U.S. Cl. ..... 315/225; 315/225; 315/DIG. 7; 363/56

[58] Field of Search ..... 315/225, 226, DIG. 7; 331/62; 363/56

[56] References Cited

U.S. PATENT DOCUMENTS

| | | | |
|---|---|---|---|
| 4,382,212 | 5/1983 | Bay | 315/225 |
| 4,392,087 | 7/1983 | Zansky | 315/219 |
| 4,461,980 | 7/1984 | Nilssen | 315/225 |
| 4,616,158 | 10/1986 | Krummel et al. | 315/225 |
| 4,710,682 | 12/1987 | Zuchtriegel | 315/226 X |

*Primary Examiner*—Eugene R. LaRoche
*Assistant Examiner*—Son Dinh
*Attorney, Agent, or Firm*—Ladas & Parry

[57] ABSTRACT

A 50 Hz or 60 Hz AC line voltage is rectified and converted to a DC voltage signal by a fluorescent lamp light ballast system. The DC voltage signal drives a pair of transistors to alternate between ON and OFF states, thereby producing a high frequency signal. A resonant circuit of the light ballast system converts the high frequency signal into a high amplitude, high frequency voltage signal needed to excite a fluorescent lamp load into operation. A protective circuit is employed to stop the generation of the high amplitude, high frequency voltage signal when the lamp load is in a burnout condition or when the lamp load is being replaced.

1 Claim, 2 Drawing Sheets

FLUORESCENT LAMP LIGHT BALLAST SYSTEM

BACKGROUND OF THE INVENTION

1. Field of the Invention

The invention relates to a light ballast system for gas discharge lamps, more particularly to a fluorescent lamp light ballast system which incorporates circuit protection and injury prevention devices.

2. Description of the Related Art

Although a variety of fluorescent lamp light ballast systems are available to consumers, these conventional systems suffer from at least one of the following defects:

1. Some of the circuit components (e.g., transistors) are damaged when burnout of the fluorescent lamp load occurs.

2. No circuitry is employed to provide power factor correction.

3. Most light ballast systems are complicated in construction and use a large number of circuit components.

4. The circuit protection measures employed by conventional gas discharge lamp light ballast systems are inadequate. No protection measures are provided for overload and high temperature conditions.

SUMMARY OF THE INVENTION

Therefore, the main objective of the present invention is to provide a fluorescent lamp light ballast system which overcomes the above mentioned drawbacks commonly associated with the prior art.

Accordingly, the preferred embodiment of a fluorescent lamp light ballast system of the present invention comprises: a power supply transforming means to transform a primary AC line voltage into a rectified DC voltage; a frequency inverter means to convert the rectified DC voltage into a high frequency voltage signal; a resonant circuit means to convert the high frequency voltage signal into a high amplitude, high frequency voltage signal; a gas discharge lamp means excited by the high amplitude, high frequency voltage signal to cause the lamp means to light; and a protective circuit means to automatically disable the frequency inverter means to stop the generation of the high amplitude, high frequency voltage signal when the lamp means is in a burnout condition or when the lamp means is being replaced.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
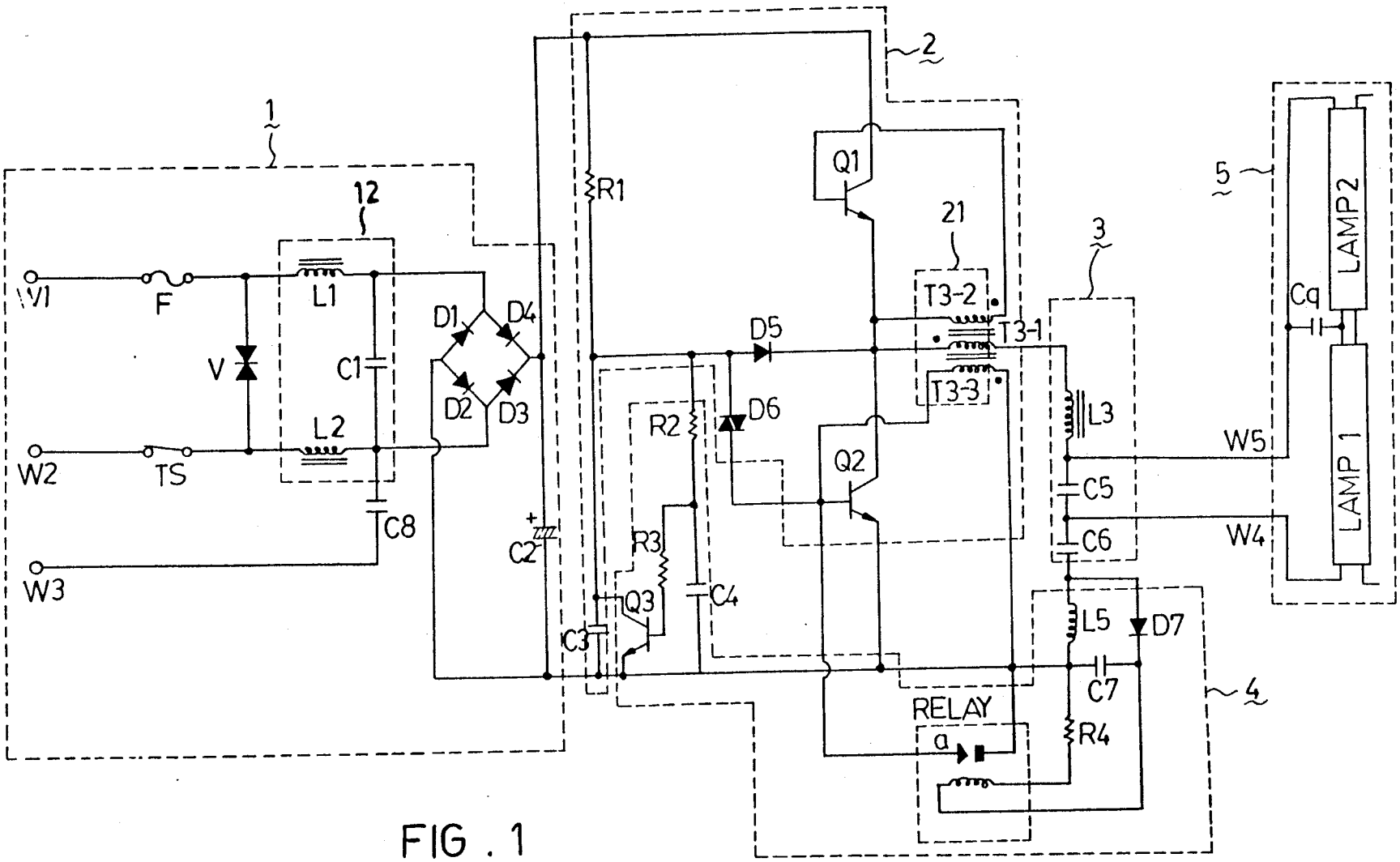
FIG. 1 is a schematic circuit diagram of the first preferred embodiment of a fluorescent lamp light ballast system according to the present invention.

Referring to FIG. 1, the first preferred embodiment of a fluorescent lamp light ballast system according to the present invention is shown to comprise a power supply transforming circuit 1, a frequency inverter circuit 2, a resonant circuit 3, a protective circuit 4 and a fluorescent lamp load 5.

The power supply transforming circuit 1 has first and second input terminals, (W1) and (W2), to receive a 50 Hz or 60 Hz primary alternating current (AC) line voltage, and a grounded third input terminal (W3). A fuse (F) is connected to input terminal (W1), while a temperature sensitive switch (TS) is connected to input terminal (W2). A varistor (V) is connected across the fuse (F) and the temperature sensitive switch (TS). The fuse (F), the temperature sensitive switch (TS) and the varistor (V) prevent sudden electrical surges in the AC line voltage from damaging the remaining circuit components of the light ballast system of the present invention.

The AC voltage across the varistor (V) is fed to an adjusting circuit 12 The adjusting circuit 12 includes induction transformers, (L1) and (L2), and a capacitor (C1) provided across the induction transformers, (L1) and (L2). The adjusting circuit 12 provides power factor and harmonic distortion adjustment or correction. The silicon steel core and the copper winding of the induction transformers, (L1) and (L2), permit the induction transformers, (L1) and (L2), to act as low frequency inductors. The combination of the induction transformers, (L1) and (L2), and the capacitor (C1), can provide leading or lagging power factor correction and can control the distortion of current supplied by an AC electrical outlet, thereby reducing the susceptibility of the light ballast system of the present invention to damages. A capacitor (C8) may be provided between input terminal (W3) and the capacitor (C1) to eliminate high frequency distortion.

The corrected AC signal output of the adjusting circuit 12 is then fed to a diode bridge rectifier (D1–D4) and to a capacitor (C2) to generate a rectified direct current (DC) voltage signal. Thus, the function of the power supply transforming circuit 1 is to convert the AC line voltage input from an AC electrical outlet into a filtered and rectified DC voltage.

The DC voltage output of the power supply transforming circuit 1 charges a capacitor (C3) of the frequency inverter circuit 2 via a resistor (R1). The gradual rise in the potential across the capacitor (C3) eventually triggers a DIAC (D6) into conduction and correspondingly triggers the transistor (Q2) into the ON state. Current then flows through a diode (D5) and the current through the resistor (R1) ceases to charge the capacitor (C3). When the transistor (Q2) conducts, current passes through winding (T3-1) of a transformer 21 and induces current in the other windings, (T3-2) and (T3-3), of the transformer 21. When this condition occurs, transistor (Q1) is turned ON and transistor (Q2) is turned OFF. As the transistors (Q1) and (Q2) alternate between ON and OFF states, a high frequency signal is generated at the output side of winding (T3-1).

The transformer 21 is a self-excited current transformer and may have an EE or EI core type with windings (T3-1), (T3-2) and (T3-3). The transformer 21 is constructed so as to provide appropriate excitation voltages to the transistors (Q1) and (Q2), and to operate the transistors (Q1) and (Q2) in an ON-OFF fashion without damaging the transistors (Q1) and (Q2) and producing excessive heat.

The high frequency output of the frequency inverter circuit 2 serves as input to the resonant circuit 3. The resonant circuit 3 produces a high amplitude, high frequency voltage signal from the high frequency output of the frequency inverter 2 and includes a high frequency inductor (L3) connected in series to capacitors (C5) and (C6). The fluorescent lamp load 5, which comprises fluorescent lamps (LAMP1) and (LAMP2), is connected in series across output terminals, (W4) and (W5), of the capacitor (C5). The high amplitude, high frequency voltage output across the capacitor (C5) excites the fluorescent lamps, (LAMP1) and (LAMP2), and causes the fluorescent lamp load 5 to light. Current through the fluorescent lamps, (LAMP1) and (LAMP2), flows through the capacitor (C6). In the preferred embodiment, the capacitor (C6) should have a capacitance which is at least ten times the capacitance of capacitor (C5). The capacitive reactance of capacitor (C6) is thus small so that the power consumed and the voltage across the capacitor (C6) is also small. Most of the output power of the fluorescent lamp light ballast system is therefore consumed by the fluorescent lamp load 5.

The protective circuit 4 is provided to prevent the preferred embodiment from generating the high amplitude, high frequency voltage output when burnout occurs or when replacing the fluorescent lamps, (LAMP1) and (LAMP2). When the fluorescent lamps, (LAMP1) and (LAMP2) are in operation, current flowing through an inductor (L5) of the protective circuit 4 is small, and the voltage across a resistor (R4) of the protective circuit 4 is insufficient to actuate a relay (RELAY).

The serial combination of capacitors, (C5) and (C6), results in a relatively small total capacitance and a relatively large capacitive reactance. A high voltage, high current condition therefore occurs when burnout of the fluorescent lamp load 5 occurs or when replacement of the fluorescent lamp load 5 is being undertaken. A high voltage is generated across the inductor (L5) and a capacitor (C7) of the protective circuit 4 is charged via a diode (D7). The RELAY is actuated and a normally open contact (a) thereof closes. The winding (T3-1) of the transformer 21 is short-circuited, and the ON-OFF transition of the transistors, (Q1) and (Q2), is stopped.

The resulting time constant of a resistor (R2) and a capacitor (C4) of the protective circuit 4 is longer than the time constant of the resistor (R1) and the capacitor (C3). When the capacitor (C3) has been charged via the resistor (R1) so as to trigger DIAC (D6) and cause the transistor (Q2) to conduct, the potential across the capacitor (C4) [which has been charged via the resistor (R2)] is sufficient to trigger transistor (Q3) into the ON state. The capacitor (C3) thus discharges via the transistor (Q3) and no longer triggers DIAC (D6) and the transistor (Q2) into the ON state. The normally open contact (a) of the RELAY reverts to the open state. Since the capacitor (C3) is not capable of driving the DIAC (D6) and the transistor (Q2) into the ON state, the ON-OFF transition of the transistors, (Q1) and (Q2), is stopped. No high amplitude, high frequency voltage signal is produced across the capacitor (C5) of the resonant circuit 3. Thus, replacement of the fluorescent lamp load 5 may be accomplished without the risk of injury even when the AC line signal is present across the input terminals (W1) and (W2). This illustrates the injury prevention measures of the fluorescent lamp light ballast system of the present invention.

Figure 2:
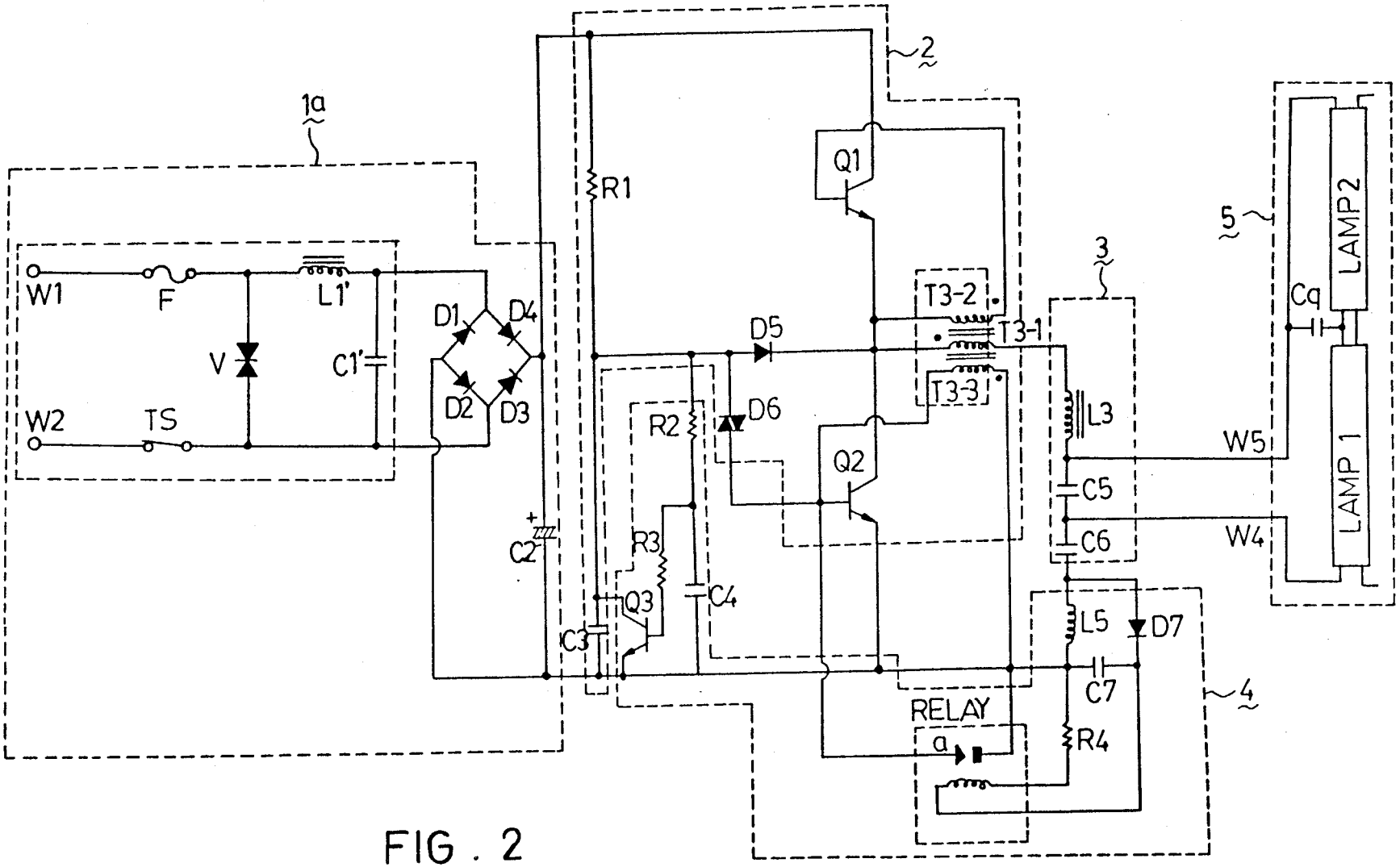
FIG. 2 is a schematic circuit diagram of the second preferred embodiment of a fluorescent lamp light ballast system of the present invention.

Referring to the schematic circuit diagram of FIG. 2, the second preferred embodiment of a fluorescent lamp light ballast system according to the present invention is shown to similarly comprise a power supply transforming circuit (1*a*), a frequency inverter circuit 2, a resonant circuit 3, a protective circuit 4 and a fluorescent lamp load 5. As with the first preferred embodiment, the power supply transforming circuit (1*a*) has input terminals, (W1) and (W2), to receive an alternating current (AC) line voltage. A fuse (F) is connected to input terminal (W1), while a temperature sensitive switch (TS) is connected to input terminal (W2). A varistor (V) is connected across the fuse (F) and the temperature sensitive switch (TS). The fuse (F), the temperature sensitive switch (TS) and the varistor (V) prevent sudden electrical surges of the AC line voltage from damaging the remaining circuit components of the light ballast system of the preferred embodiment. Power factor and harmonic distortion correction or compensation is achieved via an induction transformer (L1') and a capacitor (C1'). The combination of the induction transformer (L1') and the capacitor (C1') can provide leading or lagging power factor correction and can control the distortion of current supplied by an AC electrical outlet, thereby reducing the susceptibility of the preferred embodiment from damages. The AC voltage across the capacitor (C1') is then fed to a diode bridge rectifier (D1–D4) and to a capacitor (C2) to generate a rectified direct current (DC) voltage signal. Thus, as with the first preferred embodiment, the power supply transforming circuit (1*a*) similarly converts the AC line voltage from an AC electrical outlet into a filtered and rectified DC voltage.

The construction and operation of the frequency inverter circuit 2, the resonant circuit 3, the protective circuit 4 and the fluorescent lamp load 5 are shown to be similar to those of the first preferred embodiment and will not be detailed further.

The characteristics of the fluorescent lamp light ballast system according to the present invention are as follows:

1. A 50 Hz or 60 Hz AC line voltage is used to supply electrical power to the light ballast system of the present invention. The AC line voltage is rectified and converted to a DC voltage signal which drives a pair of transistors to alternate between ON and OFF states, thereby producing a high frequency signal. A resonant circuit converts the high frequency signal into a high amplitude, high frequency voltage signal needed to drive a fluorescent lamp load into operation. A protective circuit is employed to stop the generation of the high amplitude, high frequency voltage signal so that replacement of the fluorescent lamp load may be accomplished without the risk of injury.

2. The light ballast system uses a self-excited EE or EI core type current transformer. The inductive properties of the transformer are adjusted so as to provide appropriate excitation voltages to properly operate the transistors in an ON-OFF fashion without damaging the transistors and producing excessive heat. The useful lives of the light ballast system and the fluorescent lamp load are thus prolonged.

3. The light ballast system has a fuse, a temperature sensitive switch and a varistor to prevent electrical surges in the AC line voltage from damaging the remaining circuit components. The light ballast system thus incorporates both circuit protection and injury prevention measures.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A gas discharge lamp light ballast system, comprising:

a power supply transforming means to transform a primary AC line voltage into a rectified DC voltage;

a frequency inverter means to convert said rectified DC voltage into a high frequency voltage signal, said frequency inverter means including a first charging circuit means of a first resistor and a first capacitor charged by said rectified DC voltage via said first resistor, a first transistor means triggered by said first capacitor into an ON state, means for stopping further charging of said first capacitor when said first transistor means is in the ON state, a second transistor means, and a transistor driving means to alternatingly turn said first and said second transistor means ON and OFF so as to generate said high frequency voltage signal;

a resonant circuit means to convert said high frequency voltage signal into a high amplitude, high frequency voltage signal;

a gas discharge lamp means excited to light by said high amplitude, high frequency voltage signal; and a protective circuit means including a relay means having a normally open contact connected to said transistor driving means, a third transistor means having collector and emitter terminals connected across said first capacitor, and a second charging network of a second resistor and a second capacitor connected across said first capacitor and connected across base and emitter terminals of said third transistors means, said second resistor and said second capacitor having a time constant longer than that of said first resistor and said first capacitor, whereby, when said lamp means is in a burnout condition or said lamp means is being replaced, said normally open contact of said relay means closes, and said second charging network triggers said third transistor means into an ON state and causes said first capacitor to discharge via said third transistor means, thereby preventing said first capacitor to trigger said first transistor means into the ON state and automatically disabling the frequency inverter means to stop the generation of the high amplitude, high frequency voltage signal.

* * * * *